US006674246B2

(12) United States Patent
Moisin

(10) Patent No.: US 6,674,246 B2
(45) Date of Patent: Jan. 6, 2004

(54) BALLAST CIRCUIT HAVING ENHANCED OUTPUT ISOLATION TRANSFORMER CIRCUIT

(76) Inventor: Mihail S. Moisin, 8 Druce St., Brookline, MA (US) 02245

( * ) Notice: Subject to any disclaimer, the term of this patent is extended or adjusted under 35 U.S.C. 154(b) by 0 days.

(21) Appl. No.: 10/055,136

(22) Filed: Jan. 23, 2002

(65) Prior Publication Data

US 2003/0160571 A1 Aug. 28, 2003

(51) Int. Cl.[7] ..... H05B 37/00

(52) U.S. Cl. ..... 315/224; 315/225; 315/276; 361/52

(58) Field of Search ..... 315/224, 225, 315/276, 277; 361/52

(56) References Cited

U.S. PATENT DOCUMENTS

| | | | | |
|---|---|---|---|---|
| 4,580,013 | A | | 4/1986 | Moisin |
| 4,829,567 | A | | 5/1989 | Moisin |
| 4,864,609 | A | | 9/1989 | Moisin |
| 4,922,531 | A | | 5/1990 | Moisin |
| 5,014,305 | A | | 5/1991 | Moisin |
| 5,052,039 | A | | 9/1991 | Moisin |
| 5,081,401 | A | | 1/1992 | Moisin |
| 5,089,752 | A | * | 2/1992 | Pacholok ..... 315/307 |
| 5,124,619 | A | | 6/1992 | Moisin et al. |
| 5,138,233 | A | | 8/1992 | Moisin et al. |
| 5,138,234 | A | | 8/1992 | Moisin |
| 5,144,195 | A | | 9/1992 | Konopka et al. |
| 5,148,087 | A | | 9/1992 | Moisin et al. |
| 5,220,247 | A | | 6/1993 | Moisin |
| 5,332,951 | A | | 7/1994 | Turner et al. |
| 5,583,402 | A | | 12/1996 | Moisin et al. |
| 5,608,295 | A | | 3/1997 | Moisin |
| 5,686,799 | A | | 11/1997 | Moisin et al. |
| 5,691,606 | A | | 11/1997 | Moisin et al. |
| 5,798,617 | A | | 8/1998 | Moisin |
| 5,821,699 | A | | 10/1998 | Moisin |
| 5,866,993 | A | | 2/1999 | Moisin |
| 5,877,926 | A | | 3/1999 | Moisin |
| 5,925,986 | A | | 7/1999 | Moisin |
| 5,955,841 | A | | 9/1999 | Moisin et al. |
| 5,982,111 | A | | 11/1999 | Moisin |
| 6,011,362 | A | | 1/2000 | Moisin |
| 6,020,688 | A | | 2/2000 | Moisin |
| 6,028,399 | A | | 2/2000 | Moisin |
| 6,037,722 | A | | 3/2000 | Moisin |
| 6,069,455 | A | | 5/2000 | Moisin |
| 6,091,288 | A | | 7/2000 | Moisin |
| 6,100,645 | A | | 7/2000 | Moisin |
| 6,100,648 | A | | 8/2000 | Moisin |
| 6,107,750 | A | | 8/2000 | Moisin |
| 6,122,182 | A | | 9/2000 | Moisin |
| 6,127,786 | A | | 10/2000 | Moisin |
| 6,137,233 | A | | 10/2000 | Moisin |
| 6,157,142 | A | | 12/2000 | Moisin |
| 6,160,358 | A | | 12/2000 | Moisin |
| 6,169,375 | B1 | | 1/2001 | Moisin |
| 6,181,082 | B1 | | 1/2001 | Moisin |
| 6,181,083 | B1 | | 1/2001 | Moisin |
| 6,188,553 | B1 | | 2/2001 | Moisin |
| 6,194,843 | B1 | | 2/2001 | Moisin |
| 6,222,326 | B1 | | 4/2001 | Moisin |
| 6,236,168 | B1 | | 5/2001 | Moisin |
| 6,281,638 | B1 | | 8/2001 | Moisin |
| 2002/0011806 | A1 | | 1/2002 | Moisin |

* cited by examiner

*Primary Examiner*—David Vu
(74) *Attorney, Agent, or Firm*—Daly, Crowley & Mofford, LLP.

(57) ABSTRACT

A ballast circuit includes an output isolation transformer having a primary winding and first and second secondary terminals coupled to opposing ballast lamp terminals for additively applying potentials on the primary winding and the first and second secondary winding potentials across the lamp and limiting ground fault voltages. The circuit can include a closed loop feedback path from a load to a feedback rectifier for promoting linear operation of an input rectifier.

47 Claims, 5 Drawing Sheets

BALLAST CIRCUIT HAVING ENHANCED OUTPUT ISOLATION TRANSFORMER CIRCUIT

CROSS REFERENCE TO RELATED APPLICATIONS

Not Applicable.

STATEMENT REGARDING FEDERALLY SPONSORED RESEARCH

Not Applicable.

FIELD OF THE INVENTION

The present invention relates generally to electrical circuits and, more particularly, to resonant inverter circuits.

BACKGROUND OF THE INVENTION

There are many types of circuits for powering a load. One such circuit is a resonant inverter circuit, which receives a direct current (DC) signal, from a rectifier for example, and outputs an alternating current (AC) signal. Resonant inverter circuits are used in a wide variety of devices, such as lamp ballasts. The AC output can be coupled to a load, such as a fluorescent lamp, or to a rectifier so as to form a DC-DC converter.

Resonant inverter circuits can have a variety of configurations. For example, a half-bridge inverter circuit includes first and second switching elements, such as transistors, coupled in a half-bridge configuration. A full-bridge inverter circuit includes four switching elements coupled in a full-bridge configuration. Half-bridge and full-bridge inverter circuits are typically driven at a characteristic resonant frequency determined by the impedance values of the various circuit elements, including a resonant inductive element.

Conventional ballast circuits typically include an output transformer inductively coupled to the resonant inductive element for isolating lamps from the resonant circuit. The output transformer is a well known configuration for meeting applicable Underwriters Laboratories (UL) lamp ballast ground fault standards. In general, the current from the ballast lamp terminals is limited to a predetermined level with respect to ground. By limiting the current, a person touching the lamp terminal so as to form a path to ground through the person's body is not electrocuted.

FIG. 1 shows a typical prior art ballast circuit 10 having a conventional output isolation transformer 12. A rectifier/filter 14 receives an AC input signal on first and second input terminals 16*a,b* and provides positive and negative voltage rails 18,20. Inductively coupled inductors L1-A, L1-B can be provided on the respective positive and negative rails 18, 20. First and second switching elements 22,24 are coupled across the rails in a well known half-bridge configuration. A primary winding 26, e.g., 1.5 mH 50 turns, of the output isolation transformer combines with a resonating capacitor 28 to form a parallel resonating circuit. A secondary winding 30, e.g., 100 turns, of the transformer energizes first and second lamps LP1, LP2 each of which is coupled in parallel with respective lamp capacitors CL1, CL2. In this well known configuration, the secondary winding 30 of the transformer isolates the lamp terminals from the resonating circuit so as to limit the ground fault current flow. In the event a technician inadvertently touches a lamp terminal and thereby provides a current path to ground, the current flow through the technician's body is limited to a safe level to prevent injury. Underwriter's Laboratories promulgates standards for acceptable ballast ground fault current levels.

While the output isolation transformer provides safety, it is relatively bulky so as to require significant space on the ballast circuit board. The output transformer also consumes a relatively high amount of power. In addition, the transformer performance is negatively impacted in some applications by the corona effect. For example, in so-called instant start ballasts, in which a relatively high voltage, e.g., 500 VRMS, is applied to the lamp terminals to initiate current flow through the lamp, the transformer must provide this voltage to strike the lamp. Such a voltage can cause the transformer operating characteristics to degrade over time.

It would, therefore, be desirable to provide a ballast circuit having an enhanced output isolation configuration.

SUMMARY OF THE INVENTION

The present invention provides a circuit including a resonant inverter having a relatively efficient and reliable output isolation transformer circuit. In general, the output isolation transformer includes at least one secondary winding that combines with the primary winding to provide the required lamp strike voltage while limiting ground fault current from the lamp terminals. With this arrangement, the required voltages are efficiently applied to the lamps to initiate current flow without compromising safety, e.g., meeting applicable ballast safety standards. While the invention is primarily shown and described in conjunction with ballast circuits, it is understood that the invention is applicable to other circuits, such as power supplies and electrical motors, in which it is desirable to isolate a load and limit ground fault current.

In one aspect of the invention, a resonant circuit includes an output isolation output transformer having a first secondary winding coupled to one of the lamp terminals. A primary winding of the transformer provides a series circuit path with the first secondary windings such that a node at AC ground is disposed between the primary winding and the first secondary winding. The primary winding of the output isolation transformer can also provide an inductor forming a part of the resonating circuit. Further secondary windings can be provided as desired.

In one particular embodiment, a second secondary winding is coupled between the primary winding and the lamp. The voltage across the first secondary winding is applied to one end of the lamp and the voltages across the second secondary winding and the primary winding are applied to the other end of the lamp. The ground fault voltage from a first lamp terminal corresponds to the voltage of the first secondary winding and the ground fault voltage from the second lamp terminal corresponds to the combined voltages of the second secondary winding and the primary winding.

In another aspect of the invention, the circuit includes a feedback path from a point proximate the lamp for reducing harmonic distortion and increasing overall efficiency. In an exemplary embodiment, the circuit includes a feedback path from a closed current loop including a transformer winding to a high frequency rectifier for promoting linear operation of a low frequency input rectifier.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 2:
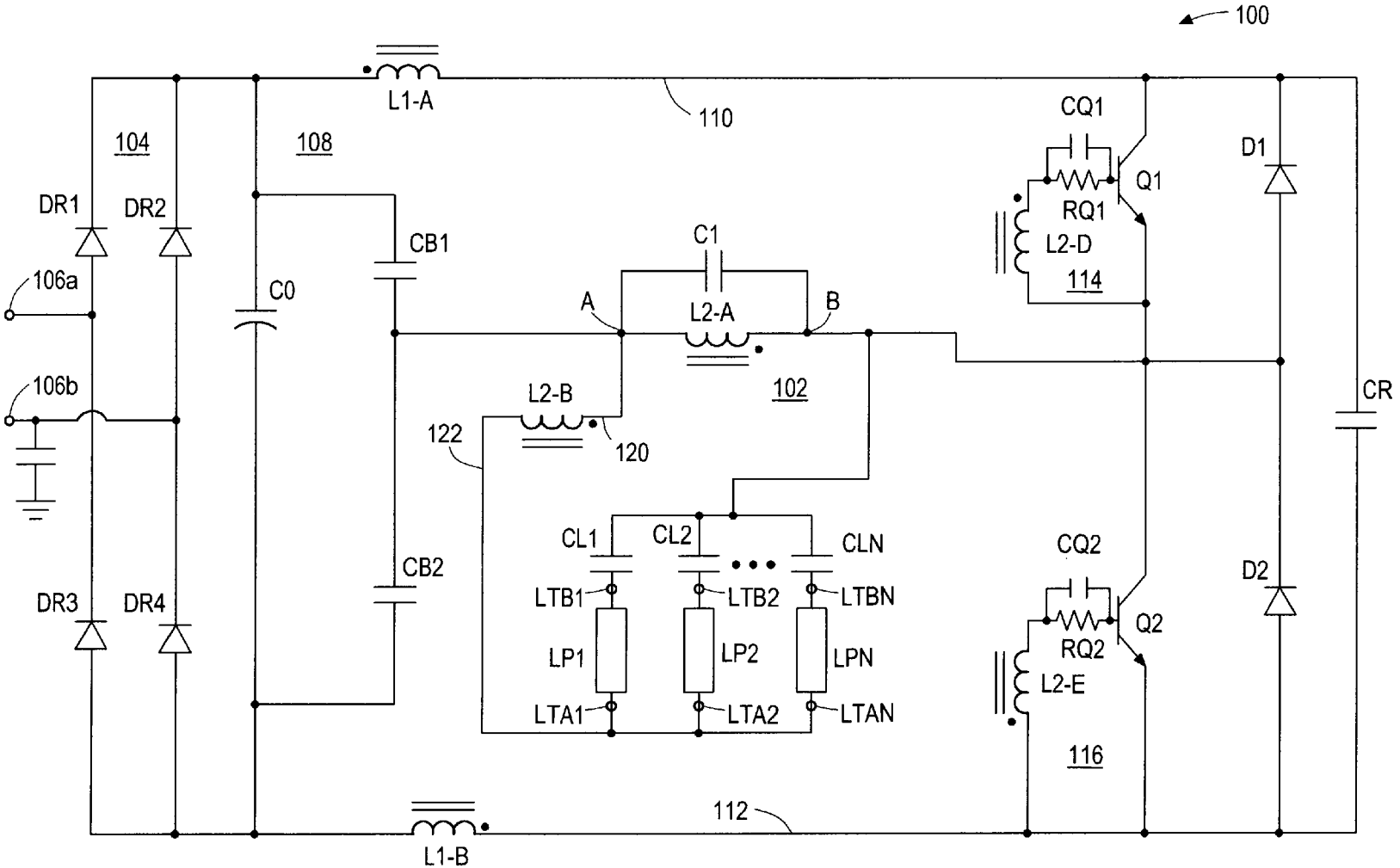
FIG. 2 is a circuit diagram of an exemplary implementation of a resonant circuit having an output isolation transformer for limiting ground fault current in accordance with the present invention.

FIG. 2 shows an exemplary circuit implementation of a lamp ballast 100 having an enhanced output isolation transformer 102 configuration in accordance with the present invention. In general, the output isolation transformer 102 provides efficient, flexible operation while limiting ground fault current to safe levels. More particularly, a first secondary winding L2-B of the output isolation transformer, as well as the primary winding L2-A, are coupled to the lamp terminals to provide desired strike voltages while limiting the lamp voltage level with respect to ground, as described more fully below.

The ballast 100 includes a rectifier 104 shown having a full bridge configuration provide by bridge diodes DR1–4. First and second input terminals 106*a,b* receive an AC input signal, such as a standard 110 VRMS, 60 Hz signal. A conventional filter stage 108 includes inductively coupled first and second inductive elements L1-A, L1-B, a filter capacitor C0, and first and second bridge capacitors CB1, CB2 coupled as shown. The first and second inductive elements L1-A, L1-B, operate to limit current in the event cross conduction occurs, i.e., the switching elements Q1, Q2 are conductive at the same time.

The first and second switching elements Q1,Q2, which are shown as transistors, are coupled in a conventional half-bridge configuration across the positive and negative voltage rails 110,112 of the inverter. The conduction states of the first and second switching elements Q1,Q2 are controlled by respective first and second control circuits 114,116. In one particular embodiment, the first control circuit 114 includes an inductive element L2-D inductively coupled to the primary winding L2-A of the resonating output isolation transformer 102. The inductive element L2-D, in combination with a capacitor CQ1 and resistor RQ1, periodically bias the first switching element Q1 to the conductive state to achieve resonant circuit operation. The second control circuit 116 can have a similar configuration to that of the first control circuit 114. This control circuit arrangement is well known to one of ordinary skill in the art. In addition, a variety of alternative control circuits will be readily apparent to one skilled in the art. Resonant inverter operation is well known to one of ordinary skill in the art.

The primary winding L2-A of the output isolation transformer 102 is coupled in parallel with a resonating capacitor C1 to form a parallel resonating inverter circuit configuration. A first secondary winding L2-B of the output isolation transformer 102 has a first terminal 120 coupled to the primary winding L2-A and a second terminal 122 coupled to a series of lamp terminals LTA1-N. These lamp terminals LTA1-N, along with lamp terminals LTB1-N on the opposite end of the lamps LP1-N, are adapted for providing an electrical connection to lamps inserted into the lamp terminals.

In operation, the first secondary winding L2-B and the primary winding L2-A combine to provide a voltage, e.g., 500 VRMS, that is sufficient to enable instant start lamp operation while limiting the voltage from a lamp terminal to ground. More particularly, the strike voltage applied across the lamps LP1-N can be budgeted, e.g., about evenly split, between the primary winding L2-A and the first secondary winding L2-B. It is well known in the art that about half of the strike voltage is not enough to trigger the lamp ionization. Therefore, by applying that voltage across the lamp, the lamp current is limited to safe values. By splitting the transformer voltage, the potential from a lamp terminal to AC ground at node A corresponds to the potential on the windings connected between that lamp terminal and node A. This arrangement limits the ground fault current from the lamp terminals while safely enabling the generation of relatively high strike voltages for starting the lamp.

Figure 3:
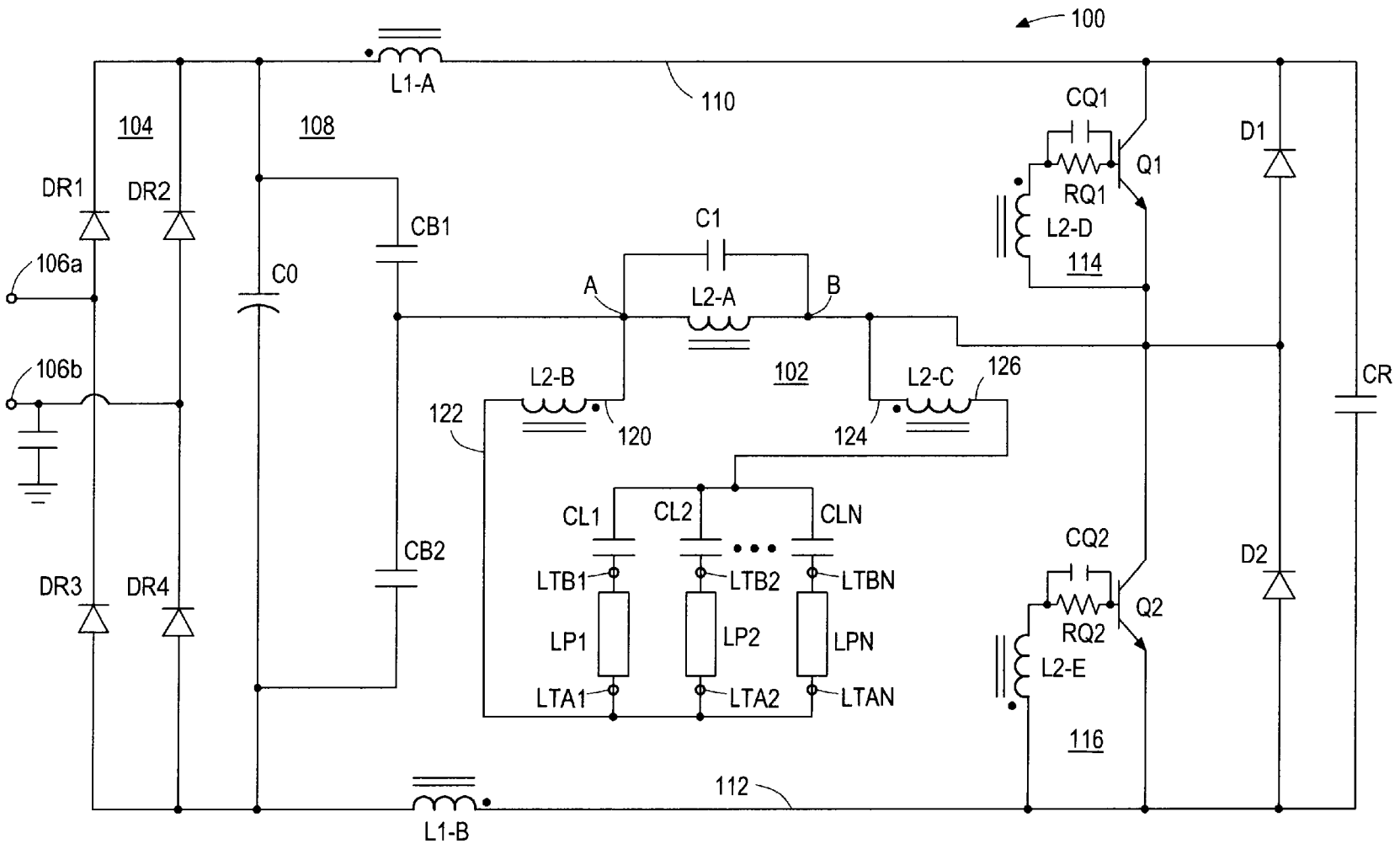
FIG. 3 is a circuit diagram showing a further implementation of a resonant circuit having an output isolation transformer for limiting ground fault current in accordance with the present invention.

In an exemplary embodiment shown in FIG. 3, the circuit includes a second secondary winding L2-C for further apportioning the available voltage budget. In one particular embodiment, the second secondary winding L2-C of the transformer has a first terminal 124 coupled to an opposite end of the transformer primary winding L2-A and a second terminal 126 coupled to respective lamp capacitors CL1-N, which are coupled in series with the lamps LP1-N.

The first node A provides AC ground at one side of the transformer primary winding L2-A. The potential from the first lamp terminal LTA1 to the first node A (AC ground) corresponds to the voltage across the first secondary winding L2-B. Similarly, the potential from the second lamp terminal LTB1 to AC ground (node A) corresponds to the voltages across the second secondary winding L2-C and the primary winding L2-A.

In one particular embodiment (not shown) the polarity of the second secondary winding L2-C can be reversed to reduce the voltage from the primary winding L2-A that is applied to the lamps.

It will be readily apparent to one of ordinary skill in the art that further secondary windings having desired polarities can be disposed throughout the circuit to meet the needs of a particular application. In addition, one of ordinary skill in the art will appreciate that the primary winding can be split into two or more windings to which various secondary windings can be coupled.

In general, the turn ratios of the first and second secondary windings L2-A, L2-B and the primary winding L2-A can be selected to budget the lamp strike voltage as desired since the winding voltages are additively applied across the lamps. Thus, the output isolation transformer circuit of the present invention provides the flexibility to control the voltages generated on the windings. For example, a combined potential of 750 VRMS can be generated on the primary and secondary windings to strike an eight foot lamp. The 750 VRMS can be safely generated by dividing the voltage between the primary and secondary windings with respect to AC ground. It is understood that the strike voltage can be apportioned among the windings as desired. In addition, the 750 VRMS can be provided by the transformer with minimal corona effects in comparison to the prior art circuit shown in FIG. 1.

Table 1 shows exemplary circuit characteristics for various circuit components shown in FIG. 3. It is understood that one of ordinary skill in the art can readily vary the component characteristics to meet the needs of a particular application without departing from the invention.

| COMPONENT | IM-PEDANCE | TURNS |
|---|---|---|
| C1 | 1 nF | — |
| L2-A | 1.5 mH | 50 Turns |
| L2-B | 1.8 mH | 55 Turns |
| L2-C | .015 mH | 5 Turns |
| CL1-N | 1 nF | — |
| L2-C,L2-D | | 1 Turn |
| CQ1, CQ2 | 0.1 $\mu$F | — |
| RQ1, RQ2 | 47 Ω | — |
| L1-A, L1-B | 1 mH | 100 Turns |
| C0 | 100 $\mu$F | — |
| CB1, CB2 | 1.0 $\mu$F | — |
| CR | 1.0 nF | — |

It is understood that one of ordinary skill in the art will recognize alternative embodiments having additional secondary windings connected to the lamps and/or additional primary windings to meet the needs of a particular application without departing from the invention. Moreover, it is understood that the invention is applicable to a wide range of circuits and devices in which it is desirable-to provide efficient, flexible output isolation. Exemplary circuits and devices include lamp ballasts, electrical motors, and power supplies.

In another aspect of the invention, a resonant circuit includes a feedback path from a load to a multi-bridge rectifier for enhancing power factor (PF) and total harmonic distortion (THD) performance of the circuit. In general, a closed loop circuit path from a transformer winding and the load to a point in the multi-bridge rectifier promotes linear operation of the input rectifier diodes.

Figure 4:
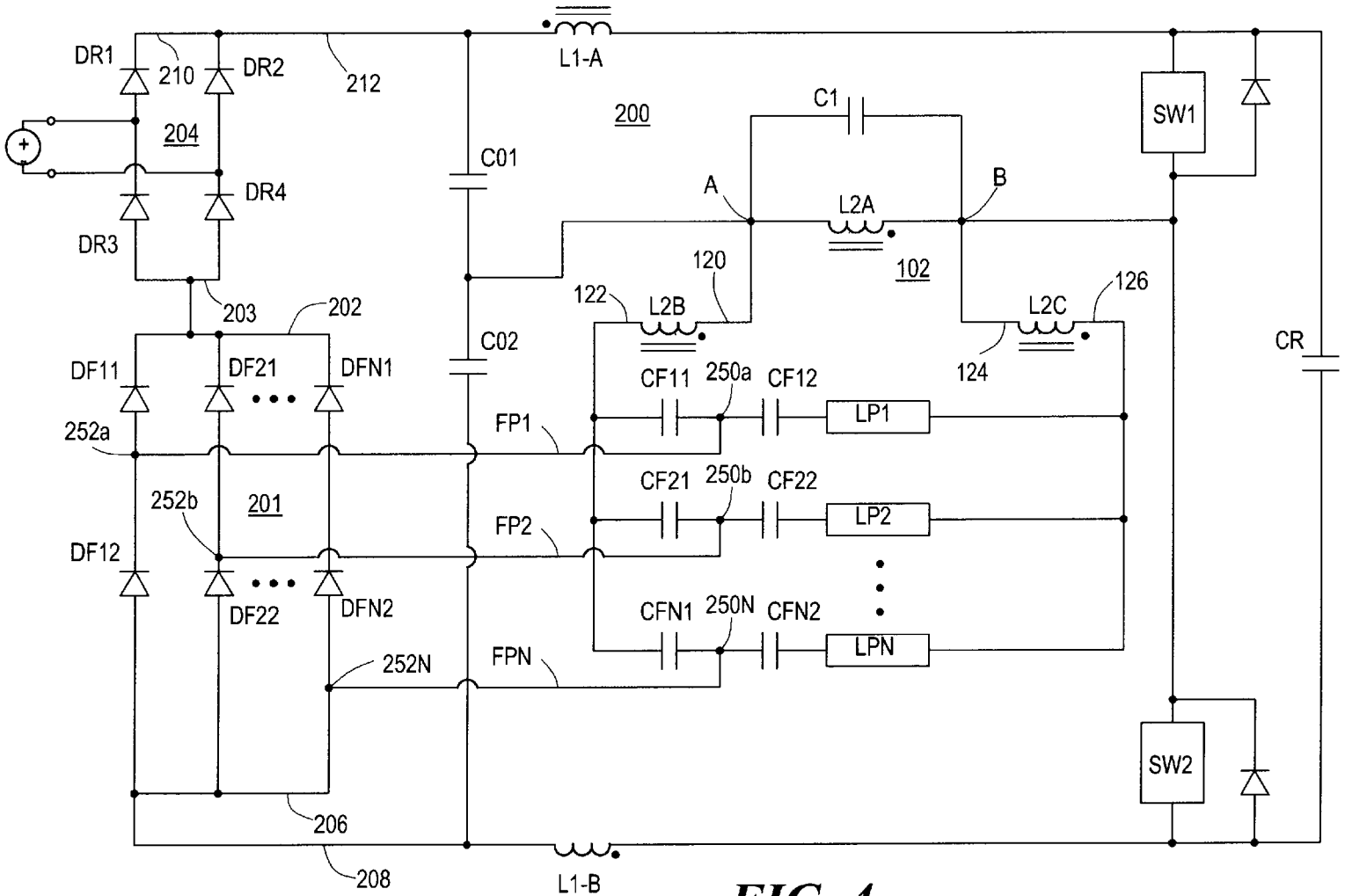
FIG. 4 is a circuit diagram showing a resonant circuit having a load feedback path in accordance with the present invention and FIG. 5 is a graphical depiction of rectifier diode operation provided by the circuit of FIG. 4.

FIG. 4 shows an exemplary resonant circuit 200 having power feedback in accordance with the present invention. A multi-bridge rectifier 201 includes pairs (DF11, DF12 ), (DF21, DF22), . . . (DFN1, DFN2) of rectifying diodes coupled end-to end. A top 202 of the multi-bridge rectifier 201 is coupled to a bottom 203 of a low frequency input rectifier 204 and a bottom 206 of the multi-bridge rectifier is coupled to a negative rail 208 of the inverter. A top of the input rectifier 210 is coupled to the positive rail 212 of the inverter.

In one particular embodiment, the resonant circuit 200 is provided as a resonant inverter circuit having a topology similar to that shown in FIG. 3, in which like elements have like reference designations. The circuit further includes a first series load path extending from the first secondary winding terminal 122 to the second secondary winding terminal 126. The first series load path includes first and second feedback capacitors CF11, CF12 coupled in a DC-blocking arrangement and terminals for energizing a first load, such as a first lamp LP1. The circuit 200 can include a number of similar load paths having respective pairs of feedback capacitors (CF21, CF22), . . . (CFN1, CFN2), for energizing additional lamps LP2, . . . LPN.

A first feedback path FP1 extends from a point 250 a between the first and second feedback capacitors CF11, CF12, to a point 252 a between a first pair DF11, DF12 of diodes in the multi-bridge rectifier 201. Similarly, additional feedback paths FP2, . . . FPN can extend from respective points 250*b*-N between the feedback capacitor pairs and points 252*b*-N between the diode pairs in the multi-bridge rectifier 201.

In operation, the aggregate voltage drops, with respect to AC ground at point A, across the first secondary winding L2B and the first feedback capacitor CF1 are applied to the point 252 a between the first pair of diodes DF11, DF12 in the multi-bridge rectifier 201. The relatively high frequency constant amplitude signal on the first feedback path FP1 periodically biases the first diode pair (DF11, DF12 ) to a conductive state, which in turn biases a pair of input rectifier diodes, e.g., DR1, DR3, to a conductive state.

Figure 5:
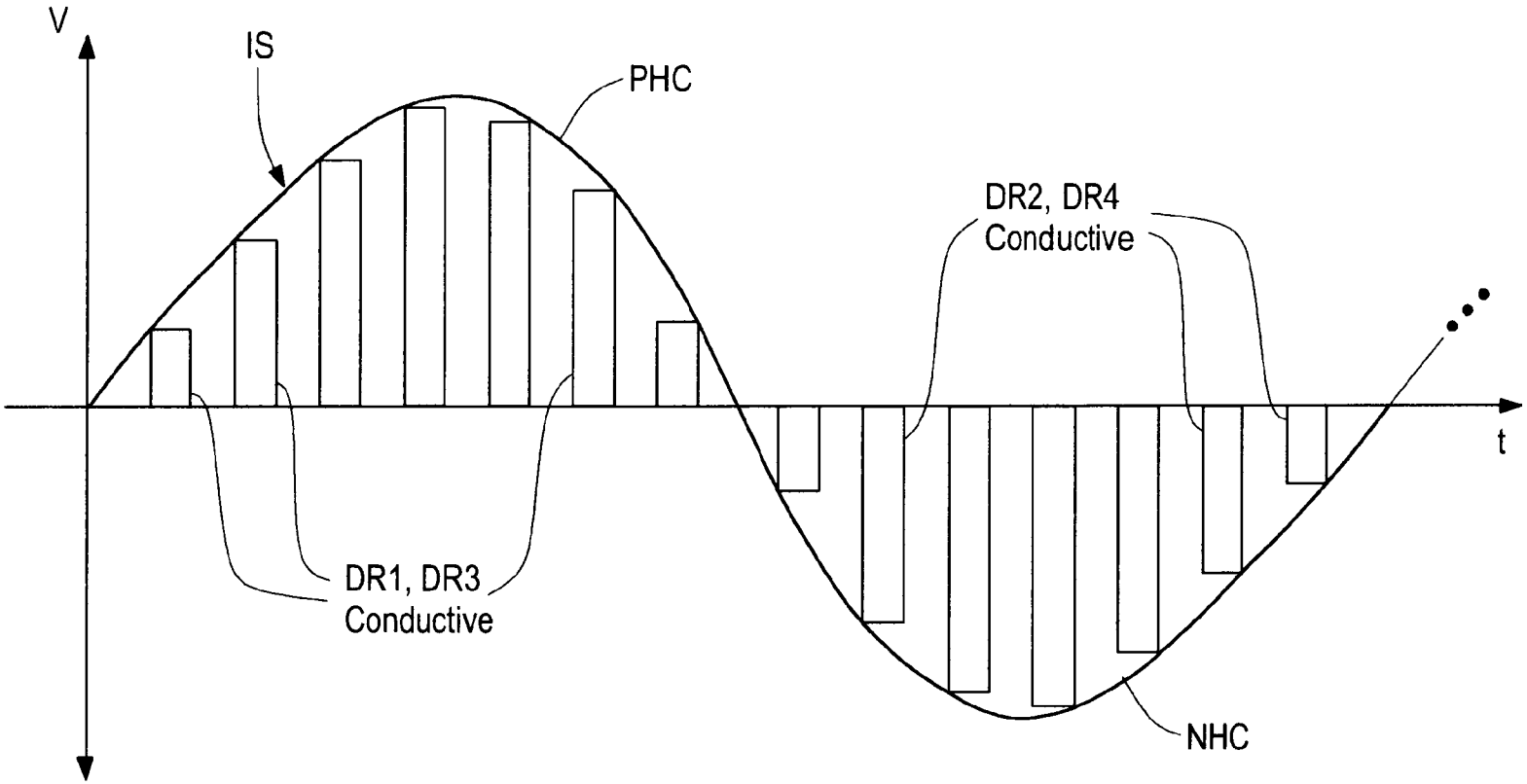

As shown in FIG. 5, the high frequency signal on the first feedback path FP1, via the multi-bridge rectifier 201, periodically biases the first diode pair DR1, DR3 of the input rectifier 204 to the conductive state during a positive half cycle PHC of the relatively low frequency input signal IS. Similarly, the second diode pair DR2, DR4 of the input rectifier is periodically conductive during a negative half cycle NHC of the input signal IS.

With this arrangement, the first storage capacitor C01 can be efficiently energized during positive half cycles of the input signal IS and the second storage capacitor C02 energized during negative half cycles. Thus, the linear operation of the input rectifier diodes provides a more efficient circuit as compared with circuits not having linear diode operation.

In addition, each feedback path FP1-N provides independent power feedback depending upon the presence of a functioning lamp. That is, the first feedback path FP1 provides substantial feedback energy when the first lamp LP1 is present and operational. If the first lamp is not present or not functioning, then the first feedback signal generally corresponds to the energy from the first secondary winding L2B of the transformer. However, it is understood that the bulk of the feedback energy comes from an operational lamp. Thus, the circuit provides self-optimizing feedback signals such that the feedback energy is based upon whether the respective load is present.

In conventional circuits having feedback paths for promoting linear diode operation, the feedback signal is typically present whether or not the load is present. The injection of feedback energy into the circuit without the load can stress the circuit and degrade performance.

Figure 1:
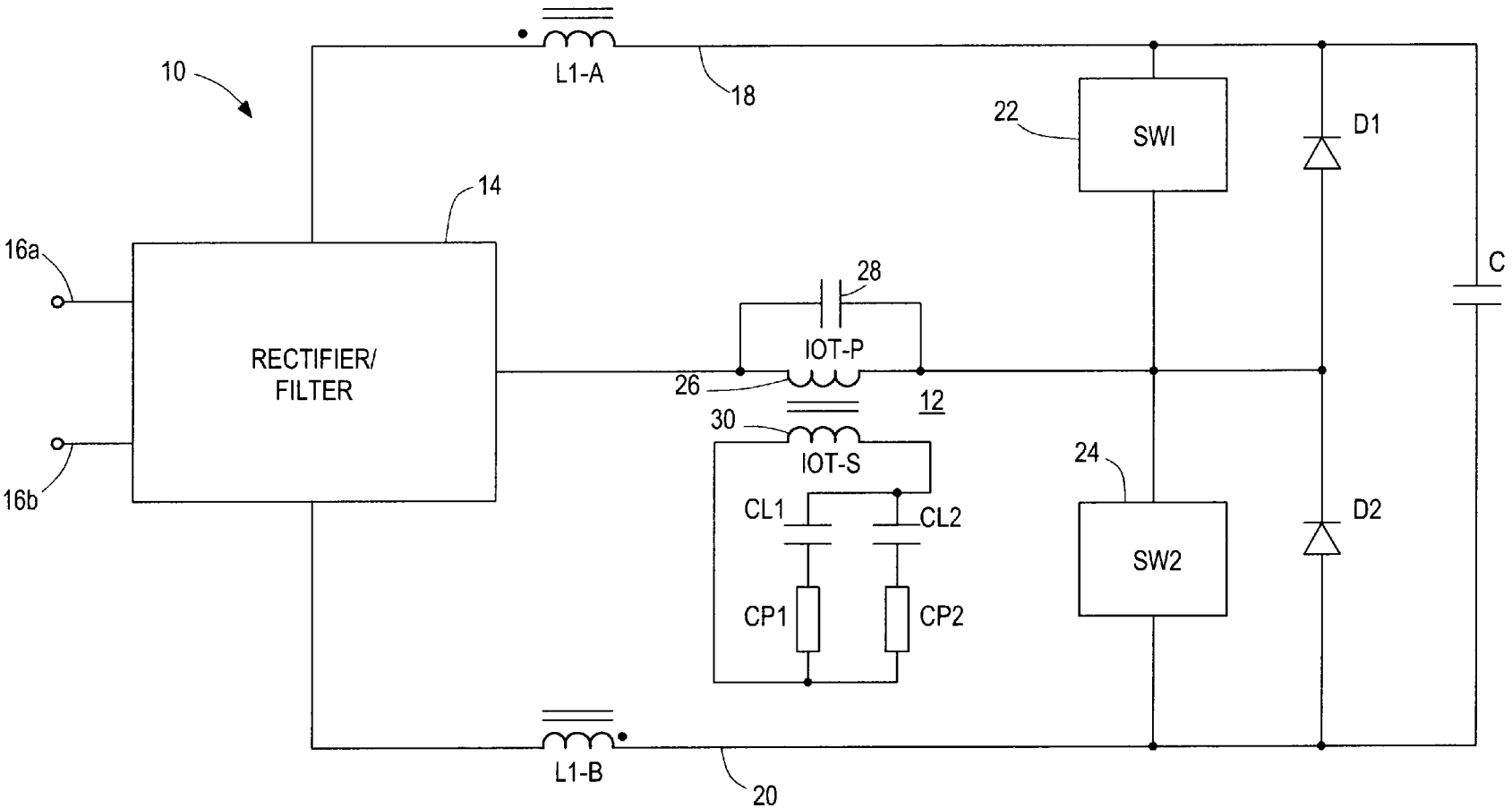
FIG. 1 Prior Art
FIG. 1 is a schematic block diagram of a prior art ballast circuit.

While the feedback circuit of the present invention is primarily shown and described in conjunction with a particular circuit topology, it is understood that the feedback arrangement is applicable to a variety of resonant circuits having a closed current path from the primary transformer winding. That is, the load is not isolated from the resonant circuit, such as by using a conventional output isolation transformer as shown in FIG. 1.

In addition, the independent feedback path arrangement enables the circuit to energize a variety of loads having differing operating characteristics. For example, the circuit 200 can energize lamps having varying lengths. Each feedback path provides the "right" amount of feedback energy for enhanced PF and THD performance.

While bipolar transistors are shown for the switching elements in the exemplary embodiments contained herein, it is understood that a variety of switching elements and switching control circuits can be used without departing from the invention. Illustrative of switching elements include transistors, such as bipolar junction transistors and field effect transistors, SCRs, and the like.

It is further understood that various inverter configurations can be used depending upon the requirements of a particular application. For example, half-bridge, full bridge, single switching element, and other inverter configurations known to one of ordinary skill in the art can be used.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A resonating circuit, comprising:

a transformer having a primary winding and a first secondary winding, wherein the first secondary winding is electrically connected to the primary winding with a node at AC ground disposed between the first secondary winding and the primary winding such that a potential on the primary winding and a potential on the first secondary winding combine to energize a load.

2. The circuit according to claim 1, further including a second secondary winding, wherein the primary winding and the first and second secondary windings provide a series circuit path.

3. The circuit according to claim 1, wherein a first ground fault potential from a first load terminal is provided by a potential across the first secondary winding.

4. The circuit according to claim 3, wherein a second ground fault potential from a second load terminal is provided by potentials across the second secondary winding and the primary winding.

5. The circuit according to claim 1, wherein the circuit includes a resonant inverter circuit.

6. The circuit according to claim 5, wherein the primary winding of the transformer corresponds to a resonant inductive element of the resonant inverter.

7. The circuit according to claim 5, wherein the inverter circuit has a half-bridge configuration.

8. The circuit according to claim 5, wherein the first and second secondary windings are adapted for energizing a lamp.

9. The circuit according to claim 1, wherein the first secondary winding has a first end coupled to the node at AC ground and a second end adapted for coupling to a first end of a load.

10. The circuit according to claim 9, further including a second secondary winding, wherein the second secondary winding has a first end coupled to the primary winding and a second end adapted for coupling to a second end of the load.

11. The circuit according to claim 10, wherein-a first ground fault path includes a path from the first secondary winding to the node at AC ground.

12. The circuit according to claim 11, wherein a second ground fault path includes a path across the second secondary winding and the primary winding to the node at AC ground.

13. The circuit according to claim 1, further including an input rectifier for receiving an AC input signal, a feedback rectifier coupled to the input rectifier, and a first feedback path providing energy from a load to the feedback rectifier and to the input rectifier to promote linear operation of diodes in the input rectifier.

14. The circuit according to claim 13, wherein the first feedback path further includes energy from the first secondary winding.

15. The circuit according to claim 14, wherein the first feedback path further includes energy from a capacitor energized by current flow through the load.

16. The circuit according to claim 13, wherein the first feedback path extends from a point between a pair of diodes coupled end-to-end in the feedback rectifier to a point located in series with the load.

17. The circuit according to claim 13, further including additional feedback paths extending from additional loads to points between further diode pairs in the feedback rectifier.

18. The circuit according to claim 17, wherein each of the first feedback path and the additional feedback paths are independent.

19. A method for providing ground fault protection in an AC circuit, comprising:

dividing a load voltage between a primary winding and a secondary winding by placing an AC ground between the primary winding and the secondary winding.

20. The method according to claim 19, further including coupling the secondary winding and the primary winding on opposite ends of the load.

21. The method according to claim 20, further including additional secondary windings in the circuit for apportioning an available voltage-budget.

22. The method according to claim 19, further including providing a feedback path from the load to a multi-bridge rectifier for promoting linear operation of an input rectifier.

23. A ballast circuit, comprising:

a resonant inverter;

a transformer having a primary winding and first and second secondary windings, wherein the primary winding corresponds to a resonant inductive element of the resonant inverter, the first and second secondary windings being electrically coupled to opposing ends of the primary winding such that voltages on the primary winding and the first and second secondary windings are adapted for being additively applied across a lamp.

24. The circuit according to claim 23, wherein a node between the primary winding and the first secondary winding corresponds to AC ground.

25. The circuit according to claim 23, wherein the primary winding and the first and second secondary windings provide a series circuit path.

26. The circuit according to claim 23, wherein a first ground fault path extends from a first lamp terminal, across the first secondary winding to AC ground.

27. The circuit according to claim 26, wherein a second ground fault path extends from a second lamp terminal, across the second secondary winding, and the primary winding to AC ground.

28. The circuit according to claim 23, wherein the ballast provides instant start operation.

29. A method for providing ballast ground fault protection, comprising:

providing a resonant inverter including a transformer having a primary winding;

electrically coupling first and second secondary windings to the primary winding of the transformer such that voltages on the first and second secondary windings and the primary winding are additively applied across a lamp.

30. The method according to claim 29, further including providing an AC ground node between a first end of the primary winding and a first end of the first secondary winding.

31. The method according to claim 30, further including forming a series circuit path through the primary winding and the first and second secondary windings.

32. A circuit, comprising:

a first rectifier;

a resonant circuit coupled to the first rectifier, the resonant circuit including a transformer having a primary winding electrically coupled to a secondary winding;

a second rectifier coupled to the first rectifier and the resonant circuit; and a feedback path from the resonant circuit to a point in the second rectifier for promoting linear operation of the first rectifier.

33. The circuit according to claim 32, wherein the first rectifier includes first and second pairs of diodes coupled end-to-end for rectifying an AC input signal.

34. The circuit according to claim 32, wherein the second rectifier includes a first pair of diodes coupled end-to-end between the first rectifier and a negative voltage rail.

35. The circuit according to claim 32, wherein the circuit includes further feedback paths for providing energy from respective loads to the second rectifier.

36. The circuit according to claim 35, wherein the second rectifier includes further pairs of diodes coupled end-to-end for each additional load energized by the circuit.

37. The circuit according to claim 36, wherein the first feedback path and the further feedback paths are independent.

38. The circuit according to claim 37, wherein the first feedback path and the further feedback paths are self-optimizing.

39. The circuit according to claim 32, further including an AC ground disposed between the primary winding and the secondary winding such that a voltage to a load is divided between the primary winding ,and the secondary winding.

40. The circuit according to claim 32, wherein the first secondary winding has a first end coupled to the node at AC ground and a second end adapted for coupling to a first end of a load.

41. The circuit according to claim 40, further including a second secondary winding, wherein the second secondary winding has a first end coupled to the primary winding and a second end adapted for coupling to a second end of the load.

42. The circuit according to claim 41, wherein a first ground fault path includes a path from the first secondary winding to the node at AC ground.

43. The circuit according to claim 42, wherein a second ground fault path includes a path across the second secondary winding and the primary winding to the node at AC ground.

44. The circuit according to claim 32, wherein the feedback path extends from the resonant circuit at a point through which load current flows to a point in the second rectifier located between first and second diodes coupled end-to-end.

45. The circuit according to claim 44, wherein the first diode in the second rectifier is coupled to the first rectifier and the second diode in the second rectifier is coupled to a negative rail of the inverter.

46. The circuit according to claim 45, wherein the feedback path provide energy from the secondary winding and the load to the second rectifier.

47. The circuit according to claim 46, wherein the feedback path further provides energy from a capacitor coupled in series with the load.

* * * * *